US006012859A

United States Patent [19]

Boller et al.

[11] Patent Number: 6,012,859

[45] Date of Patent: Jan. 11, 2000

[54] PROCESSING APPARATUS AND METHOD FOR PROCESSING PHOTOSENSITIVE MATERIAL

[75] Inventors: Billy K. Boller; Ralph L. Piccinino, Jr., both of Rochester, N.Y.

[73] Assignee: Eastman Kodak Company, Rochester, N.Y.

[21] Appl. No.: 09/045,033

[22] Filed: Mar. 20, 1998

[51] Int. Cl.[7] ..... G03D 3/08; G03D 13/04; G03D 3/02

[52] U.S. Cl. ..... 396/620; 396/626; 396/627; 396/636

[58] Field of Search ..... 396/617, 620, 396/624, 626, 627, 630, 636, 641, 615

[56] References Cited

U.S. PATENT DOCUMENTS

| | | | |
|---|---|---|---|
| 4,362,376 | 12/1982 | Otani | 396/615 |
| 4,987,438 | 1/1991 | Goto et al. | 396/626 |
| 5,179,404 | 1/1993 | Bartell et al. | 396/641 |
| 5,270,762 | 12/1993 | Rosenburgh et al. | 396/626 |
| 5,311,235 | 5/1994 | Piccinino, Jr. et al. | 396/626 |
| 5,347,337 | 9/1994 | Patton et al. | 396/636 |
| 5,386,261 | 1/1995 | Patton et al. | 396/626 |
| 5,420,658 | 5/1995 | Manico et al. | 396/627 |
| 5,432,581 | 7/1995 | Patton et al. | 396/636 |
| 5,499,073 | 3/1996 | Pummell | 396/615 |
| 5,621,939 | 4/1997 | Yoshida et al. | 396/617 |
| 5,781,820 | 7/1998 | Rosenburgh et al. | 396/636 |
| 5,860,037 | 1/1999 | Kurokawa | 396/617 |

*Primary Examiner*—D. Rutledge
*Attorney, Agent, or Firm*—David A. Novais; Frank Pincelli

[57] ABSTRACT

A processing apparatus and method for processing photosensitive material includes processing paths which comprise downwardly inclined and upwardly inclined portions with respect to a conveying direction of photosensitive material. The processing paths are thin channel paths and are oriented so as to provide for a compact processor. Also, the processing apparatus includes several processing sections which are structured to permit an easy assembly and disassembly of the apparatus and thereby facilitate maintenance. The processing apparatus combines the concept of cascading solution flow and nozzle delivery of processing solution for recirculation and replenishment.

42 Claims, 6 Drawing Sheets

PROCESSING APPARATUS AND METHOD FOR PROCESSING PHOTOSENSITIVE MATERIAL

FIELD OF THE INVENTION

The present invention relates to the field of photoprocessing, and more particularly, to a processing apparatus and method for processing photosensitive material.

BACKGROUND OF THE INVENTION

The processing of photosensitive material such as photographic film involves a series of steps such as developing, bleaching, fixing, washing and drying. In this process, a continuous web of film or cut sheet of film or photographic paper is sequentially conveyed through a series of stations or tanks, with each one containing a different processing solution appropriate to the process step at that station. In conventional processors, the tanks of the processor are usually set forth in a side by side relationship. This arrangement increases the footprint of the processor and thus requires a large amount of space.

U.S. Pat. No. 5,386,261 discloses a low volume photographic processing apparatus that utilizes a plurality of processing modules. In this document, nozzles are arranged along the processing path of the processing module for introducing recirculated fluid into the processing path. With the specific module structure of this document, the recirculated fluid is introduced into the processing path via nozzles and there is no provision for a cascading flow of fresh processing solution in the processing path.

SUMMARY OF THE INVENTION

The present invention provides for a processing apparatus and method which includes the benefits of a thin-channel rack and tank arrangement as shown in, for example, U.S. Pat. No. 5,311,235, the subject matter of which is herein incorporated by reference, and uses less floor space.

The processing apparatus of the present invention includes stackable processing sections which each include a portion of a continuous processing path. The processing path in each of the stackable processing sections include downwardly and upwardly inclined portions with respect to a direction of travel of the photosensitive material. With the arrangement of the present invention, it is possible to provide a cascading flow of fresh processing solution along the upwardly inclined portion of each of the processing paths, and at the same time, recirculate processing solution from the cascading processing solution flow to the downwardly inclined portion of each of the processing paths.

Each of the processing paths of the processing apparatus of the present invention can be approximately V-shaped so as to provide for the upwardly and downwardly inclined portions and provide for a compact apparatus. Additionally, each of the processing sections can be stackable so as to take up less floor space.

Furthermore, each of the processing paths can be thin channels which can include textured surfaces so as promote agitation of solution.

Additionally, the continuous processing path can convey photosensitive material in a light-tight manner so as to minimize exposure to air as you enter the different processing sections.

The present invention provides for a processing apparatus for processing photosensitive material. The apparatus comprises a first section having a first processing path for the passage of photosensitive material. The first processing path has a first section downward inclined portion and a first section upward inclined portion, with respect to a conveying direction of the photosensitive material in the first processing path. The apparatus further comprises a second processing section having a second processing path for the passage of photosensitive material. The second processing path has a second section downward inclined portion and a second section upward inclined portion with respect to a conveying direction of the photosensitive material in the second processing path. The apparatus also includes a third processing section having a third processing path for the passage of photosensitive material. The third processing path has a third section downward inclined portion and a third section upward inclined portion with respect to a conveying direction of the photosensitive material in the third processing path.

The present invention also provides for a processing apparatus for photosensitive material which comprises a continuous processing path for a passage of photosensitive material. The continuous processing path includes a plurality of approximately V-shaped sections. The processing apparatus further includes means for delivering processing solution to the photosensitive material in the continuous processing path. The means for delivering processing solution extends along the approximately V-shaped sections of the continuous processing path.

The present section also provides for a processing apparatus for processing photosensitive material which comprises a first member having a first member surface; a second member having a first surface and a second surface, the second member being pivotally connected to the first member so as to be movable between at least first and second positions, one of the at least first and second positions of the second member being a second member operating position in which one of the first and second surfaces of the second member faces the first member surface of the first member, so as to define a first section of a processing path therebetween for the passage of photosensitive material.

The present invention also provides for a processing apparatus for processing photosensitive material which comprises a first member; and at least one intermediate member. The at least one intermediate member is adapted to be removably positioned adjacent to the first member so as to define a portion of a processing path for photosensitive material therebetween. The apparatus further comprises a second member which is adapted to be removably positioned adjacent to the at least one intermediate member on a side of the at least intermediate member which is opposite to the first member, so as to define a further portion of the processing path therebetween.

The present invention also relates to a method of processing photosensitive material. The method comprises the steps of conveying a photosensitive material along a first processing path, with the first processing path having a downwardly inclined portion and an upwardly inclined portion with respect to a conveying direction of the photosensitive material in the first processing path; transporting the photosensitive material from an exit of the first processing path to an entrance of a second processing path; conveying the photosensitive material along the second processing path, with the second processing path having a downwardly inclined portion and an upwardly inclined portion with respect to a conveying direction of the photosensitive material in the second processing path; transporting the photosensitive material from an exit of the second processing path to an entrance of a third processing path; and conveying the photosensitive material along the third processing path, with the third processing path comprising a downwardly inclined portion and an upwardly inclined portion with respect to a conveying direction of the photosensitive material in the third processing path.

DETAILED DESCRIPTION OF THE INVENTION

Figure 1:
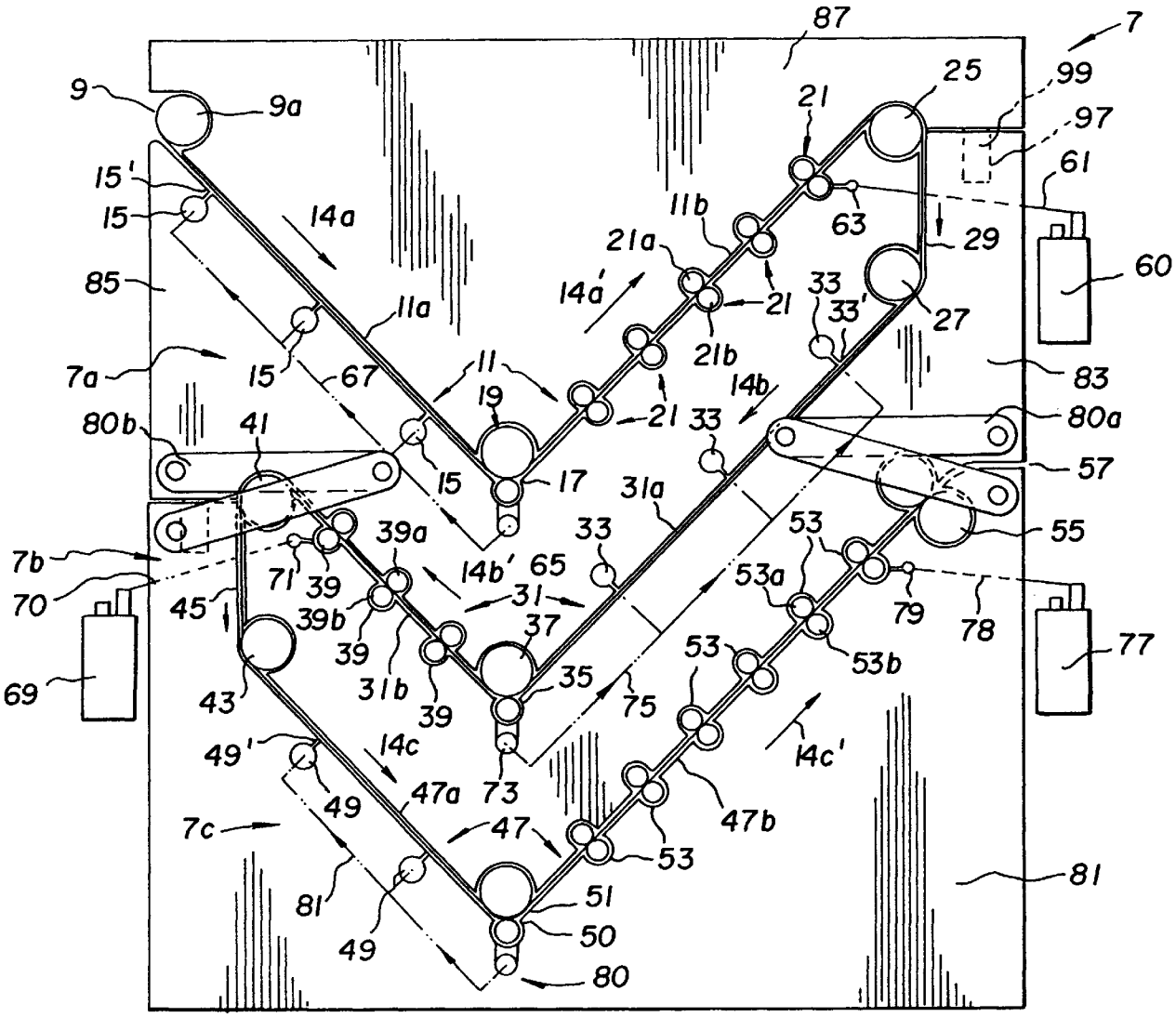
FIG. 1 illustrates a first example of the processing apparatus of the present invention.

Referring now to the drawings, wherein like reference numerals designate identical or corresponding parts throughout the several views, FIG. 1 illustrates a first example of a processing apparatus 7 of the present invention. As illustrated in FIG. 1, processing apparatus 7 generally comprises three processing sections 7*a*, 7*b*, 7*c* which are stacked one above the other. Each of processing sections 7*a*, 7*b*, 7*c* pertains to a different processing stage for the processing of photosensitive material. For example, processing section 7*a* could be a developing processing stage for applying a developing solution; processing section 7*b* could be a bleaching processing stage for applying a bleaching solution; and processing section 7*c* could be a washing processing stage for applying a washing solution.

Referring first to processing section 7*a*, this section includes an entrance 9 which leads to a first processing path 11. Entrance 9 can include a conveying roller or assembly 9*a* which conveys photosensitive material into first processing path 11 in the direction of arrow 14*a*. First processing path 11 includes a downwardly inclined portion 11*a* and an upwardly inclined portion 11*b* with respect to conveying direction 14*a*, 14*a*' of the photosensitive material.

Positioned in downwardly inclined portion 11*a* are nozzles 15 which lead to nozzles openings 15' entering into downward inclined portion 11*a* of processing path 11. A transitional portion 17 of processing path 11 between downwardly inclined portion 11*a* and upwardly inclined portion 11*b* includes conveying roller pair or assembly 19 which conveys the photosensitive material from downwardly inclined portion 11*a* to upwardly inclined 11*b*. Extending along upwardly inclined portion 11*b* are tray portions 21 which are curved to retain processing solution and serve as overflow processing sections. Each of tray portions 21 include conveying rollers 21*a*, 21*b* which are at least partially submerged in tray portions 21. As shown in FIG. 1, inclined portions 11*a* and 11*b* are arranged so as to define an approximately V-shaped first processing path 11 which provides for a compact structure.

An exit of upwardly inclined portion 11*b* of first processing path 11 leads to conveying rollers or assemblies 25, 27 and a connecting path 29. Connecting path 29 serves to guide the photosensitive material from the exit of the upwardly inclined portion 11*b* of first conveying path 11 to a second processing path 31.

Second processing path 31 includes a downwardly inclined portion 31*a* and an upwardly inclined portion 31*b* with respect to conveying direction 14*b*, 14*b*' of the photosensitive material in second processing path 31. Downwardly inclined portion 31*a* includes further nozzles 33 which lead to nozzle openings 33' that lead into the downwardly inclined portion 31*a* of processing path 31. At a transition portion 35 between downwardly inclined portion 31*a* and upwardly inclined portion 31*b* of second processing path 31, there is located a further conveying roller pair or assembly 37 which conveys the photosensitive material from downwardly inclined portion 31*a* to upwardly inclined portion 31*b* of processing path 31. Further tray portions 39 are positioned along upwardly inclined portion 31*b*. Tray portions 39 can be curved to retain processing solution and serve as overflow processing sections. Each tray portion 39 includes conveying rollers 39*a*, 39*b* analogous to tray portions 21 of first processing path 11.

At the exit of second processing path 31, there are further conveying rollers or assemblies 41, 43 which convey the photosensitive material through a connecting path 45 and to an entrance of a third processing path 47. Connecting paths 29 and 45 assure that the photosensitive material travels along the processing path in a light-tight manner. Third processing path 47 includes a downwardly inclined portion 47*a* and upwardly inclined portion 47*b* with respect to conveying direction 14*c*, 14*c*' of photosensitive material. As in the first and second processing paths 11, 31, downwardly inclined portion 47*a* of third processing path 47 includes nozzles 49 which are similar to nozzles 15 and 33 of respective processing paths 11 and 31. Nozzles 49 lead to openings 49' and into downwardly inclined portion 47*a* of third processing path 47. A transition portion 50 between downwardly inclined portion 47*a* and upwardly inclined portion 47*b* includes a further conveying roller pair or assembly 51 which serves to convey the photosensitive material from downwardly inclined portion 47*a* to upwardly inclined portion 47*b*. Upwardly inclined portion 47*b* includes tray portions 53 which are curved and similar in construction to tray portions 21 and 39 of the respective first and second processing paths 11 and 31. Similar to tray portions 21 and 39, tray portions 53 includes conveying rollers 53*a*, 53*b* positioned therein. The photosensitive material is conveyed along upwardly inclined portion 47*b* to a further conveying roller pair or assembly 55 which leads the photosensitive material to an exit 57 of the processing apparatus 7 and to, for example, a drying stage.

Like first processing path 11, the downwardly incline portion 31*a* and the upwardly inclined portion 31*b* of second processing path 31 form an approximately V-shaped processing path that is positioned vertically below the first processing path 11. Downwardly inclined portion 47*a* and upwardly inclined portion 47*b* of third processing path 47 also form an approximately V-shaped processing path and is positioned vertically below second processing path 31. It is noted that the arrangement of each of the processing paths 11, 31, 47 of the present invention is not limited to the approximate V-shape as shown. That is, depending on design considerations, the angle between the downwardly inclined portions and the upwardly inclined portions of each of the processing paths 11, 31, 47 could be varied (i.e. made greater or larger) so as to provide for various dimensions of the apparatus.

As shown in FIG. 1, downwardly inclined portion 11*a* of first processing path 11, upwardly inclined portion 31*b* of second processing path 31 and downwardly inclined portion 47*a* of third processing path 47 can be on planes which are approximately parallel to each other. Furthermore, upwardly inclined portion 11*b* of processing path 11, downwardly inclined portion 31*a* of second processing path 31 and upwardly inclined portion 47*b* of third processing path 47 can be on further planes which are approximately parallel to each other. This arrangement provides for a compact processing apparatus which takes up less floor space. It is noted that the present invention is not limited to the parallel arrangement of the inclined portions as illustrated in FIG. 1. That is, as discussed above, the angle between the downwardly and upwardly inclined portions of each processing path 11, 31, 47 could be varied based on design considerations.

The replenishment and recirculation system of processing assembly 7 will now be described. As previously explained, the upwardly inclined portions 11*b*, 31*b* and 47*b* of each of the processing paths respectively include tray portions 21, 39, 53. This provides for a cascading overflow application of processing solution in a manner as described in copending U.S. application Ser. No. 08/947,688 filed Oct. 9, 1997, now U.S. Pat. No. 5,923,916 the subject matter of which is herein incorporated by reference. That is, with reference to first processing section 7*a*, a first fresh processing solution can be supplied via a pump and container arrangement 60 (which can be, i.e., a bellows pump) via a line 61 to an entrance 63 of upper-most tray portion 21. The first processing solution will overflow the upper-most tray portion 21 and cascade down along upwardly inclined portion 11*b* in a direction opposite to conveying direction 14*a*' of the photosensitive material in upwardly inclined portion 11*b*. The first processing solution will sequentially overflow the tray portions 21 as it flows downward along upwardly inclined portion 11*b* so as to provide for a cascading downward flow of the first processing solution. The downwardly cascading flow of the first processing solution will collect in a recirculating pump and trough assembly 65 located in a vicinity of transition portion 17; and recirculating assembly 65 will thereafter recirculate the first processing solution along line 67 to each of nozzles 15, so as to supply recirculated first processing solution into downwardly inclined portion 11*a*.

The same process for recirculation and replenishment will be applicable to second processing section 7*b* and third processing section 7*c*. That is, in second processing section 7*b*, a pump and container arrangement 69 similar to arrangement 60 will supply a second fresh processing solution via line 70 into an entrance 71 of an upper-most tray portion 39. The second processing solution will overflow upper-most tray portion 39 and cascade in a downward direction along upwardly inclined portion 31*b*. The second processing solution is collected in a recirculating pump and trough assembly 73 located in a vicinity of transition portion 35. Recirculating assembly 73 will recirculate the second processing solution along line 75 to each of nozzles 33 along downwardly inclined 31*a* so as to supply recirculated processing solution along downwardly inclined portion 31*a*.

Third section 7*c* includes a further pump and container arrangement 77 which supplies a third fresh processing solution via line 78 into an entrance 79 to an upper-most one of tray portions 53. The third solution will over flow upper-most tray portion 53 and cascade downward along upwardly inclined portion 47*b*. The third solution is thereafter collected at a recirculating pump and trough assembly 80 located in a vicinity of transition portion 50. Recirculating assembly 80 will recirculate the third processing solution along line 81 to each of nozzles 49 located along downwardly inclined portion 47*a*, so as to provide recirculated solution along the downwardly inclined portion 47*a*.

Therefore, pump and container arrangement 60 could include fresh developing solution, pump and container arrangement 69 could include fresh bleaching solution and pump and container arrangement 77 could include fresh washing solution.

Also, it is noted that the number of processing paths or sections, nozzles and tray portions shown in the drawings is one operative example. That is, the number of processing paths or sections, nozzles and tray portions utilized depends on design considerations such as, for example, processing path length, type of processing solution, speed, etc.

An operating example of processing apparatus 7 will now be explained. During use of processing apparatus 7, photosensitive material having its emulsion side down enters at entrance 9 and travels along downwardly inclined portion 11*a* where it is impinged and processed by recirculated processing solution delivered by nozzles 15. As previously described, this recirculating solution is supplied to nozzles 15 via recirculating assembly 65. The photosensitive material will thereafter be conveyed towards upwardly inclined portion 11*b* where it is processed by fresh processing solution supplied by pump and container arrangement 60 and applied by tray portions 21 which create a cascading downward flow. At this point, the photosensitive material will have passed through, for example, a developing section. The photosensitive material thereafter travels along connecting path 29 toward second processing path 31 and downwardly inclined portion 31*a*. As the photosensitive material having its emulsion side up is conveyed along downwardly inclined portion 31*a*, nozzles 33 apply recirculated processing solution such as bleaching solution to the photosensitive material. As previously described, this recirculating processing solution is supplied to nozzles 33 by way of recirculating assembly 73. The photosensitive material is thereafter conveyed to upwardly inclined portion 31*b* where fresh bleaching solution is applied in a cascading manner by way of tray portions 39. The photosensitive material thereafter exits second processing path 31 and travels along connecting portion 45 into third processing path 47. At third processing path 47, the photosensitive material travels with its emulsion side down along downward inclined portion 47*a* which includes nozzles 49 that supply recirculated solution to the photosensitive material. As previously explained, this recirculating solution is supplied to nozzles 49 by way of recirculating assembly 80. As the photosensitive material is conveyed to upwardly inclined portion 47*b*, fresh solution is applied via tray portions 53 by way of a cascading downward flow. The photosensitive material is thereafter led to exit 57 of the processing assembly 7 and thereafter to, for example, a drying stage.

Figure 2:
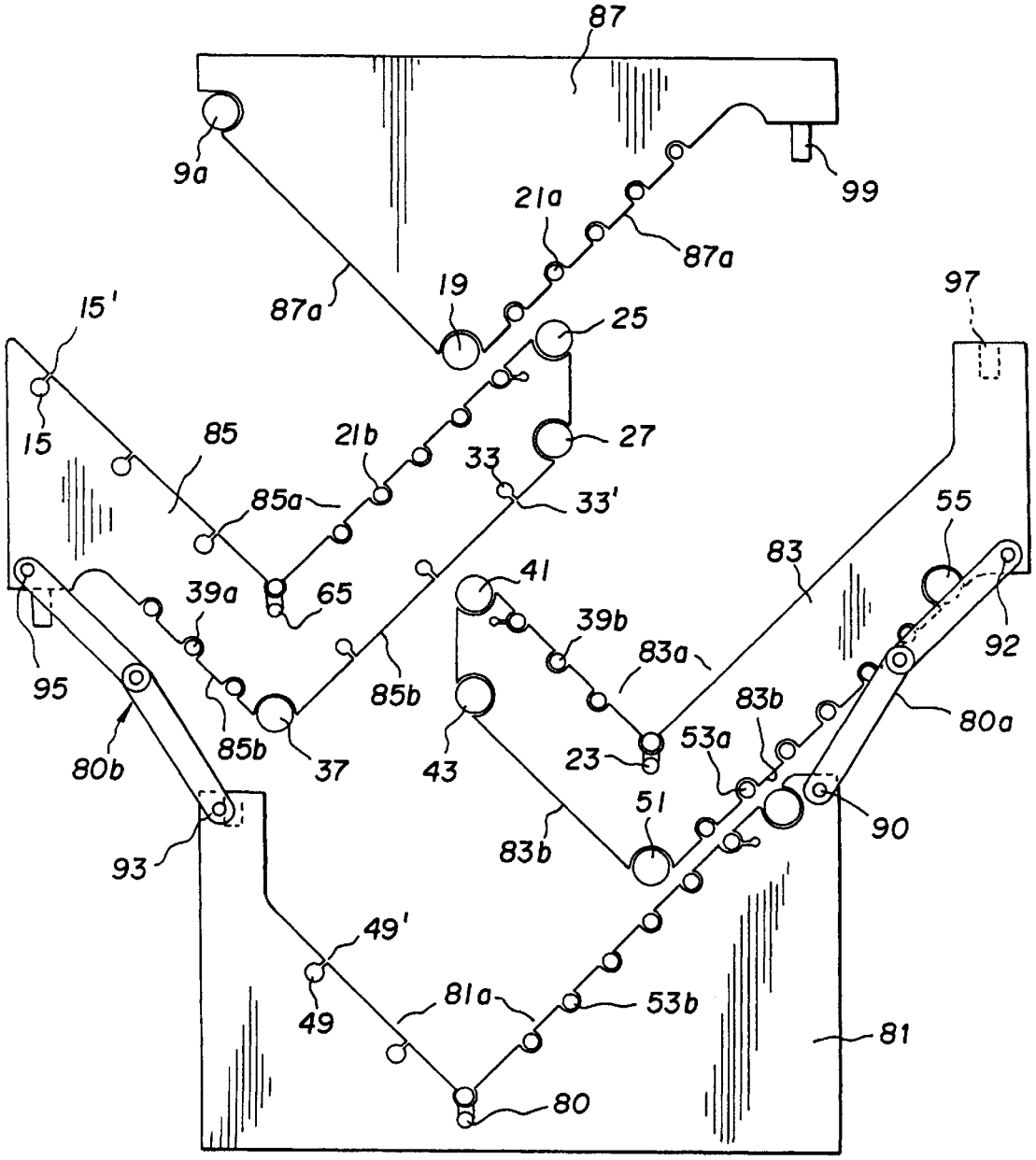
FIG. 2 illustrates the processing apparatus of FIG. 1 in an opened state.

Referring now to FIGS. 1 and 2, processing apparatus 7 of FIG. 1 further includes pivoting assemblies 80*a* and 80*b*. Pivoting assemblies 80*a* and 80*b* facilitate the disassembly and assembly of processing apparatus 7 for, i.e., maintenance purposes. Pivoting assemblies 80*a* and 80*b* permit processing apparatus 7 to be opened from the position illustrated in FIG. 1 to the position illustrated in FIG. 2. As shown in FIG. 2, processing apparatus 7 is basically composed of four members 81, 83, 85 and 87 having facing surfaces. Each of members 81, 83, 85 and 87 can include openings which define either the previously described nozzle openings or tray portions. For example, base member 81 includes openings for nozzles 49 and for tray portions 53 as illustrated in FIG. 1.

First member 81 is basically a base member and as illustrated in FIG. 2 pivotable assembly 80*a* is pivotably connected at one end 90 to first member 81 and at a second end 92 to second member 83. Pivotal assembly 80*b* includes a first end 93 which is pivotably connected to first member 81 and a second end 95 which is pivotably connected to third member 85. With this arrangement, second member 83 can be movable from a non-operating position as illustrated in a FIG. 2 to an operating position as illustrated in FIG. 1 in which second member 83 is positioned adjacent to first member 81. In this position, third processing path 47 will be defined between a first member surface 81*a* of first member 81 and surface 83*b* of second member 83.

With respect to third member 85, after first member 83 is placed in the operating position as illustrated in FIG. 1, third member 85 can be movable from a non-operating position as illustrated in FIG. 2 to an operating position as illustrated in FIG. 1, in which third member 85 is positioned adjacent to second member 83, so as to define second processing path 31 between surfaces 85*b*and 83*a*. As described above, each of second and third members 83, 85 can include the required nozzle openings and tray portions as described above with reference to FIG. 1.

Furthermore, second member 83 can include, for, example, an opening 97 which can interengage with a projection 99 on fourth member 87. Thus, after third member 85 is positioned in the operating position as illustrated in FIG. 1, fourth member 87 can be mounted to second member 83 so as to define a top of processing apparatus 7, and to further define processing path 11 between surface 87*a* of fourth member 87 and surface 85*a* of third member 85. Like the previously described members, each of fourth member 87 and third member 85 include the necessary openings to define the nozzles and/or tray portions as described with reference to FIG. 1. Additionally, each of members 81, 83, 85, 87 include the necessary openings for receiving the required conveying rollers or assemblies as described with reference to FIG. 1.

Therefore, second member 83 which includes surfaces 83*a*, 83*b* can form part of processing path 47 and part of processing path 31; while third member 85 which includes surfaces 85*a*, 85*b* can form part of processing path 31 and part of processing path 11. This feature in combination with the processing paths being approximately V-shaped and being positioned one above the other provides for a compact structure.

Also, as illustrated in FIG. 2, surface 81*a* of first member 81 defines an approximately V-shaped pattern such that when second member 83 which defines a corresponding approximately V-shaped structure is positioned in the operating position as illustrated in FIG. 1, it will easily fit adjacent to surface 81*a*. At the same time, third member 85 is approximately V-shaped in structure which permits third member 85 to be positioned adjacent to second member 83. Finally, fourth member 87 includes surface 87*a* which defines an approximately V-shaped pattern, so as to permit the positioning of fourth member 87 adjacent to third member 85 which is correspondingly approximately V-shaped in structure. It is noted that the shape of the members 81, 83, 85, 87 is not limited to the illustrated shapes. That is, the shapes can be modified so long as the members 81, 83, 85, 87 provide for the upwardly and downwardly inclined portions of the processing paths as described. It is further noted that the amount of members 81, 83, 85, 87 is not limited to the number shown in the figures. That is, depending on design considerations, such as the number of processing sections, type of processing, speed, etc., the arrangement of the present invention could include more or less members 81, 83, 85, 87, than that shown in the figures.

Thus, the present invention provides for a compact arrangement which is easy to assemble and maintain since as illustrated in FIG. 2, the arrangement can be easily manipulated between operating and non-operating positions.

Figure 3:
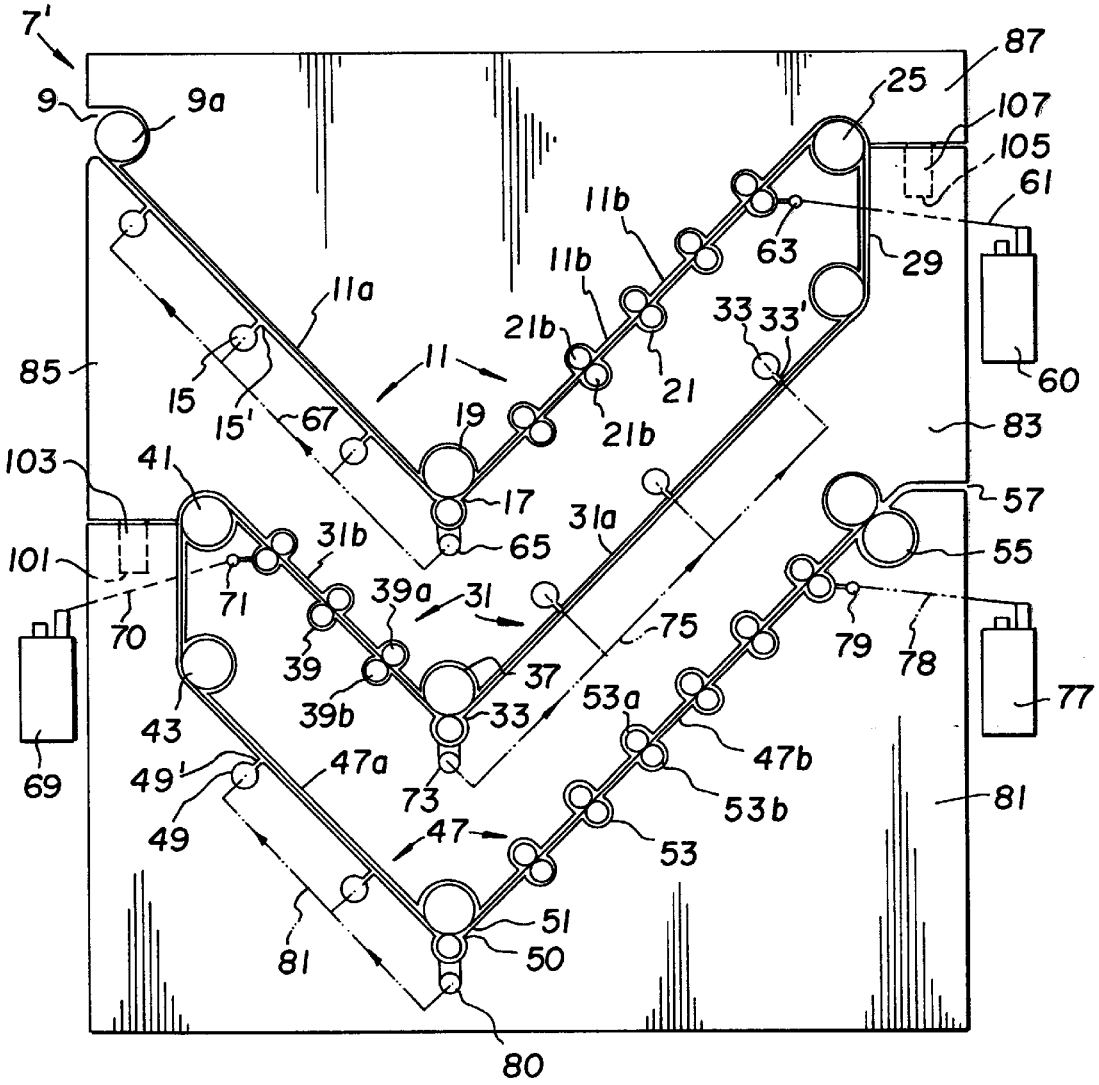
FIG. 3 is a further example of a processing apparatus in accordance with the present invention.
Figure 4:
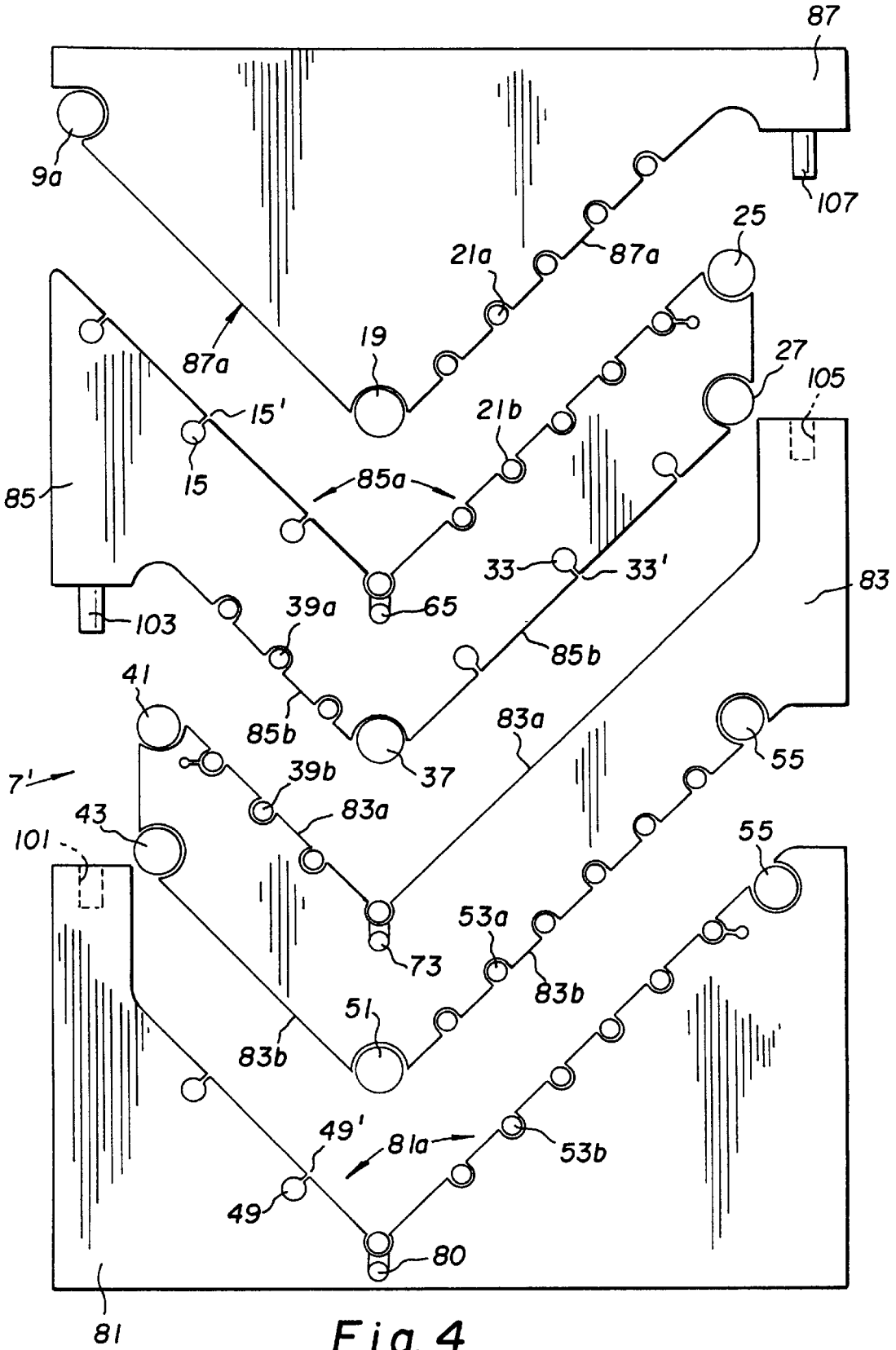
FIG. 4 is a view of the processing apparatus of FIG. 3 in an opened state.

The present invention is not limited to the use of pivotable assemblies 80*a* and 80*b* as illustrated in FIG. 1. As noted FIG. 3, members 81, 83, 85 and 87 that make up processing apparatus 7 can be interengaged with each other through the use of cooperating projections and openings. Processing assembly 7' illustrated in FIG. 3 is similar to processing assembly 7 illustrated in FIG. 1 except for the pivoting assemblies 80*a*, 80*b*. Referring to processing assembly 7' as shown in FIG. 4, first member 81 can include an opening 101 which cooperates with a projection 103 on third member 85. Also, second member 83 can include an opening 105 which cooperates with a projection 107 on fourth member 87. It is noted that the specific positioning of the openings and projections is not limited to those shown in FIG. 4 but can be reversed such that, for example, member 81 can include a projection and member 85 can include an opening. With this arrangement, members 81, 83, 85 and 87 can be fitted one on top of the other as illustrated in FIG. 4 and assembled to a position as illustrated in FIG. 3 to provide for processing assembly 7'. The configuration for the processing paths and the operation of processing assembly 7' is the same as described above with respect with processing assembly 7. Like processing assembly 7, processing assembly 7' can be disassembled in a reliable and efficient manner for maintenance and/or cleaning.

Figure 5:
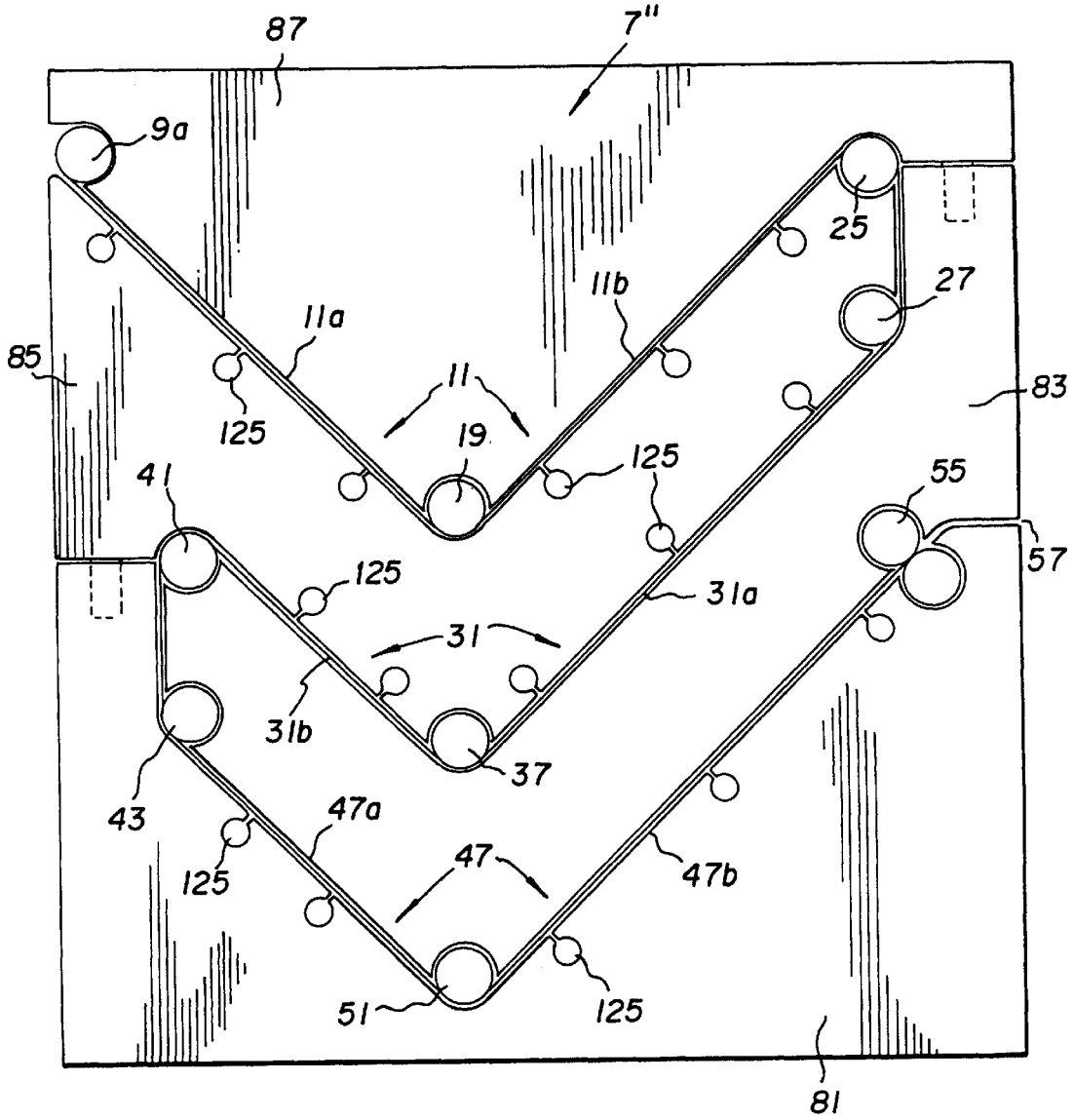
FIG. 5 is a further example of a processing apparatus in accordance with the present invention.

It is further noted that the present invention is not limited to the specific configuration of the nozzles and tray portions as illustrated in FIG. 1. For example, as illustrated by processing assembly 7" of FIG. 5, the upwardly and downwardly inclined portions of each of the processing paths 11, 31 and 47 can include only nozzles 125 which supply processing solution to each of the processing paths.

Figure 6A:
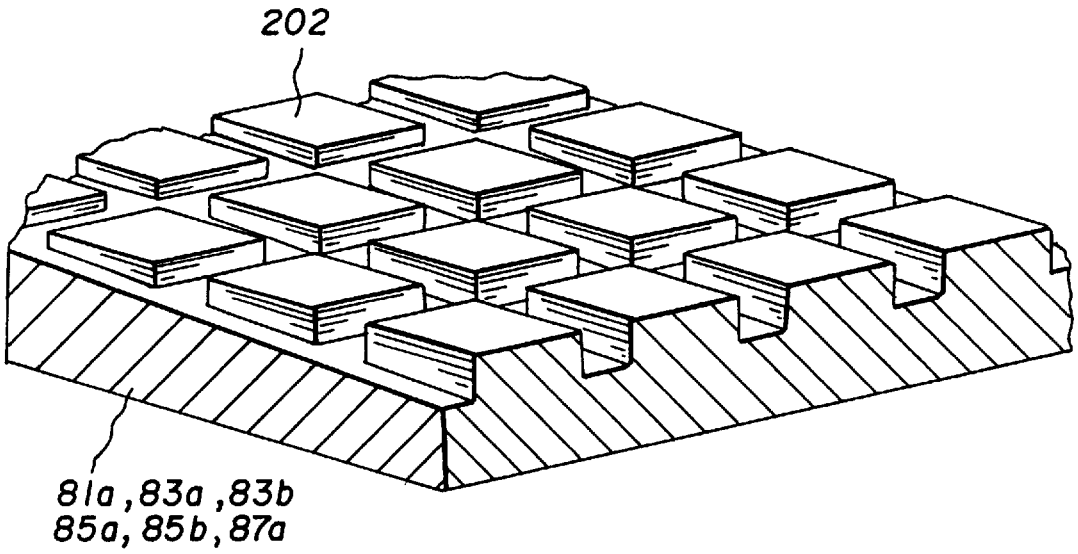
FIGS. 6A and 6B illustrates examples of textured surfaces along the processing paths of the processing apparatus of the present invention.
Figure 6B:
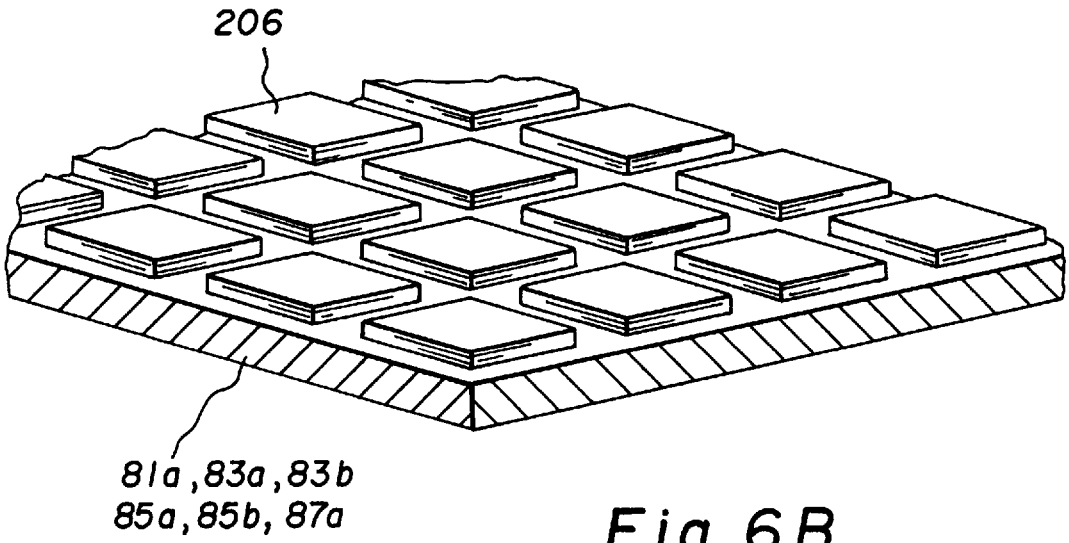

Referring now to FIGS. 6A and 6B, surfaces 81*a*, 83*a*, 83*b*, 85*a*, 85*b* and 87*a* of members 81, 83, 85 and 87 can define textured fluid-bearing surfaces which can be formed based on design considerations on each of these surfaces. The surfaces are textured to enhanced fluid agitation and can be formed by any known process, e.g. knurling, molded, EDM electrical discharge machine, etc. Each of the surfaces can be structured so as to have knurls 202 or 206 as respectively illustrated in FIGS. 6A and 6B. In FIG. 6A, the knurls 202 are cantered so as to improve the flow of processing solution between the photosensitive material and the surfaces, and prevent the photosensitive material from sticking on the surfaces.

The invention has been described in detail with particular reference to certain preferred embodiments thereof, but it will be understood that variations and modifications can be effected within the spirit and scope of the invention.

What is claimed is:

1. An apparatus for processing photosensitive material, the apparatus comprising:

a first section having a first processing path for a passage of photosensitive material therethrough, said first processing path having a first section downward inclined portion and a first section upward inclined portion with respect to a conveying direction of the photosensitive material in the first processing path;

a second section having a second processing path for a passage of photosensitive material therethrough, said second processing path having a second section downward inclined portion and a second section upward inclined portion with respect to a conveying direction of the photosensitive material in the second processing path;

a third section having a third processing path for a passage of photosensitive material therethrough, said third processing path having a third section downward inclined portion and a third section upward inclined portion with respect to a conveying direction of the photosensitive material in the third processing path;

each of said first, second and third section downward inclined portions comprise nozzles for delivering processing solution to the photosensitive material; and each of said first, second and third section upward inclined portions comprise overflow processing sections which provide for a cascading processing solution flow.

2. An apparatus according to claim 1, wherein each of said first processing path, said second processing path and said third processing path are approximately V-shaped and are vertically positioned one above the other.

3. An apparatus according to claim 1, wherein each of said first, second and third section downward inclined portions, and each of said first, second and third section upward inclined portions comprise means for delivering processing solution to the photosensitive material.

4. An apparatus according to claim 3, wherein said means for delivering processing solution comprises at least one of nozzles or tray portions, said tray portions retaining and permitting an overflow of processing solution.

5. An apparatus according to claim 1, wherein each of said overflow processing sections define curved tray portions having a roller at least partially positioned therein.

6. An apparatus according to claim 1, further comprising:

a first supply assembly which supplies a first processing solution to at least one of said overflow processing sections of said first section upward inclined portion, so as to overflow said at least one overflow processing section of said first section upward inclined portion and create a cascading downward flow in said first section upward inclined portion which is opposite a conveying direction of the photosensitive material in said first section upward inclined portion;

a second supply assembly which supplies a second processing solution to at least one of said overflow processing sections of said second section upward inclined portion, so as to overflow said at least one overflow processing section of said second section upward inclined portion and create a cascading downward flow in said second section upward inclined portion which is opposite to a conveying direction of the photosensitive material in said second section upward inclined portion; and a third supply assembly which supplies a third processing solution to at least one of said overflow processing sections of the third section upward inclined portion so as to overflow said at least one overflow processing section of said third section upward inclined portion and create a cascading downward flow in said third section upward inclined portion which is opposite to a conveying direction of the photosensitive material in said third section upward inclined portion.

7. An apparatus according to claim 6, wherein each of said first, second and third supply assemblies is part of a pump system.

8. An apparatus according to claim 6, further comprising:

a first recirculating pump assembly for recirculating processing solution from the cascading downward flow in said first section upward inclined portion to the nozzles in said first section downward inclined portion;

a second recirculating pump assembly for recirculating processing solution from the cascading downward flow in said second section upward inclined portion to the nozzles in said second section downward inclined portion; and a third recirculating pump assembly for recirculating processing solution from the cascading downward flow in said third section upward inclined portion to the nozzles in said third section downward inclined portion.

9. An apparatus according to claim 1, further comprising:

a first connecting path which connects an exit from said first section upward inclined portion to an entrance of said second section downward inclined path in a light-tight manner; and a second connecting path which connects an exit from said second section upward inclined portion to an entrance of said third section downward inclined portion in a light-tight manner.

10. An apparatus according to claim 1, further comprising a plurality of conveying rollers which convey the photosensitive material through each of said first, second and third processing paths.

11. An apparatus according to claim 1, wherein each of said first section downward inclined portion, said second section upward inclined portion and said third section downward inclined portion extend along planes which are approximately parallel to each other; and each of said first section upward inclined portion, said second section downward inclined portion, and said third section upward inclined portion extend along further planes which are approximately parallel to each other.

12. An apparatus according to claim 3, wherein said processing solution is one of a washing solution, a fixing solution, a developing solution or a bleaching solution.

13. An apparatus according to claim 1, wherein said processing solution is one of a washing solution, a fixing solution, a developing solution or a bleaching solution.

14. A processing apparatus for processing photosensitive material, the apparatus comprising:

a first member having a first member surface;

a second member having first and second surfaces, said second member being pivotally connected to said first member so as to be movable between at least first and second positions, one of said at least first and second positions of said second member being a second member operating position in which one of said first and second surfaces of said second member faces said first member surface of said first member, so as to define a first section of a processing path therebetween for the passage of photosensitive material; and a third member having first and second surfaces, said third member being pivotally connected to said first member so as to be movable between at least third and fourth positions, one of said at least third and fourth positions being a third member operating position in which one of said first and second surfaces of said third member faces the other of said first and second surfaces of said second member, so as to define a second section of said processing path therebetween.

15. An apparatus according to claim 14, further comprising:

a fourth member having a fourth member surface, said fourth member being adapted to be positioned in a fourth member operating position in which said fourth member surface of said fourth member faces the other of said first and second surfaces of said third member, so as to define a third section of said processing path therebetween.

16. An apparatus according to claim 15, wherein a portion of the fourth member surface comprises means for delivering processing solution to the photosensitive material.

17. An apparatus according to claim 16, wherein said means for delivering processing solution is at least one of nozzle openings or overflow tray portions.

18. An apparatus according to claim 14, wherein said first member is a base member and a portion of said first member surface comprises means for delivering processing solution to the photosensitive material.

19. An apparatus according to claim 18, wherein said means for delivery processing solution is at least one of nozzles openings or overflow tray portions.

20. An apparatus according to claim 14, wherein said first member surface is approximately V-shaped.

21. An apparatus according to claim 14, wherein said second member is approximately V-shaped and at least one of said first and second surfaces of said second member comprises means for delivering processing solution to the photosensitive material.

22. An apparatus according to claim 21, wherein said means for delivering processing solution is at least one of nozzle openings or overflow tray portions.

23. An apparatus according to claim 14, wherein said third member is approximately V-shaped and at least one of said first and second surfaces of said third member comprises means for delivering processing solution to the photosensitive material.

24. An apparatus according to claim 23, wherein said means for delivery processing solution is at least one of nozzle openings or overflow tray portions.

25. A processing apparatus for processing photosensitive material, the apparatus comprising:

a first member;

at least one intermediate member, said at least one intermediate member being adapted to be removably positioned adjacent to said first member so as to define a portion of a processing path for photosensitive material therebetween;

a second member, said second member being adapted to be removably positioned adjacent to said at least one intermediate member on a side of said at least one intermediate member which is opposite said first member, so as to define a further portion of the processing path therebetween; and wherein said first member comprises a first member surface which includes means for delivering processing solution to the photosensitive material.

26. An apparatus according to claim 25, wherein said means for delivering processing solution is at least one of nozzle opening or overflow tray portions.

27. An apparatus according to claim 25, wherein said at least one intermediate member is approximately V-shaped, said at least one intermediate member comprising an intermediate member surface which includes means for delivering processing solution to the photosensitive material.

28. An apparatus according to claim 27, wherein said means for delivering processing solution is at least one of nozzle openings or overflow tray portions.

29. An apparatus according to claim 27, wherein said intermediate member surface comprises a textured surface.

30. An apparatus according to claim 25, wherein said second member comprises a second member surface which includes means for delivering processing solution to the photosensitive material.

31. An apparatus according to claim 30, wherein said means for delivering processing solution is at least one of nozzle openings or overflow tray portions.

32. An apparatus according to claim 30, wherein said second member surface comprises a textured surface.

33. An apparatus according to claim 25, wherein said first member surface comprises a textured surface.

34. A method of processing photosensitive material, the method comprising the steps of:

conveying a photosensitive material along a first processing path, said first processing path having a downwardly inclined portion and an upwardly inclined portion with respect to a conveying direction of the photosensitive material in said first processing path;

transporting the photosensitive material from an exit of said first processing path to an entrance of a second processing path;

conveying the photosensitive material along said second processing path, said second processing path having a downwardly inclined portion and an upwardly inclined portion with respect to a conveying direction of the photosensitive material in the second processing path;

transporting the photosensitive material from an exit of the second processing path to an entrance of a third processing path;

conveying the photosensitive material along the third processing path, said third processing path comprising a downwardly inclined portion and an upwardly inclined portion with respect to a conveying direction of the photosensitive material in the third processing path; and wherein said step of transporting the photosensitive material from the exit of the first processing path to the entrance of the second processing path comprising the step of transporting the photosensitive material in a light-tight manner along a first connecting path, and said step of transporting the photosensitive material from the exit of said second processing path to the entrance of the third processing path comprises the step of transporting the photosensitive material in a light-tight manner along a second connecting path.

35. A method according to claim 34, comprising the step of locating each of said first, second and third processing paths in a vertical manner one above the other.

36. A method according to claim 34, comprising the steps of:

supplying processing solution to the upwardly inclined portion of each of said first, second and third processing paths so as to cause a downwardly cascading processing solution flow; and recirculating processing solution from said downwardly cascading processing solution flow to the downwardly inclined portions of each of said first, second and third processing paths.

37. A method according to claim 34, wherein each of said first, second and third processing paths are approximately V-shaped.

38. A method according to claim 36, wherein said processing solution is one of a washing solution, a fixing solution, a developing solution or a bleaching solution.

39. A processing apparatus for processing photosensitive material, the apparatus comprising:

a first member having a first member surface;

a second member having first and second surfaces, said second member being pivotally connected to said first member so as to be movable between at least first and second positions, one of said at least first and second positions of said second member being a second member operating position in which one of said first and second surfaces of said second member faces said first member surface of said first member, so as to define a first section of a processing path therebetween for the passage of photosensitive material; and wherein said first member is a base member and a portion of said first member surface comprises means for delivering processing solution to the photosensitive material.

40. A processing apparatus for processing photosensitive material, the apparatus comprising:

a first member having a first member surface;

a second member having first and second surfaces, said second member being pivotally connected to said first member so as to be movable between at least first and second positions, one of said at least first and second positions of said second member being a second member operating position in which one of said first and second surfaces of said second member faces said first member surface of said first member, so as to define a first section of a processing path therebetween for the passage of photosensitive material; and wherein said first member surface is approximately V-shaped.

41. A processing apparatus for processing photosensitive material, the apparatus comprising:

a first member;

at least one intermediate member, said at least one intermediate member being adapted to be removably positioned adjacent to said first member so as to define a portion of a processing path for photosensitive material therebetween;

a second member, said second member being adapted to be removably positioned adjacent to said at least one intermediate member on a side of said at least one intermediate member which is opposite said first member, so as to define a further portion of the processing path therebetween; and wherein said second member comprises a second member surface which includes means for delivering processing solution to the photosensitive material.

42. A method of processing photosensitive material, the method comprising the steps of:

conveying a photosensitive material along a first processing path, said first processing path having a downwardly inclined portion and an upwardly inclined portion with respect to a conveying direction of the photosensitive material in said first processing path;

transporting the photosensitive material from an exit of said first processing path to an entrance of a second processing path;

conveying the photosensitive material along said second processing path, said second processing path having a downwardly inclined portion and an upwardly inclined portion with respect to a conveying direction of the photosensitive material in the second processing path;

transporting the photosensitive material from an exit of the second processing path to an entrance of a third processing path;

conveying the photosensitive material along the third processing path, said third processing path comprising a downwardly inclined portion and an upwardly inclined portion with respect to a conveying direction of the photosensitive material in the third processing path;

supplying processing solution to the upwardly inclined portion of each of said first, second and third processing paths so as to cause a downwardly cascading processing solution flow; and recirculating processing solution from said downwardly cascading processing solution flow to the downwardly inclined portions of each of said first, second and third processing paths.

* * * * *